US011167441B2

(12) United States Patent
Lee

(10) Patent No.: US 11,167,441 B2
(45) Date of Patent: Nov. 9, 2021

(54) HANDHELD PUNCHING DEVICE

(71) Applicant: Chung-Yi Lee, New Taipei (TW)

(72) Inventor: Chung-Yi Lee, New Taipei (TW)

( * ) Notice: Subject to any disclaimer, the term of this patent is extended or adjusted under 35 U.S.C. 154(b) by 102 days.

(21) Appl. No.: 16/728,947

(22) Filed: Dec. 27, 2019

(65) Prior Publication Data

US 2021/0197416 A1 Jul. 1, 2021

(51) Int. Cl.
*B26F 1/36* (2006.01)

(52) U.S. Cl.
CPC ..... *B26F 1/36* (2013.01); *B26F 2001/365* (2013.01)

(58) Field of Classification Search
CPC ..... B26F 1/36; B26F 1/04; B26F 2001/365
See application file for complete search history.

(56) References Cited

U.S. PATENT DOCUMENTS 440,835 A * 11/1890 wickman ..... B41J 3/38 400/136
507,674 A * 10/1893 connell ..... B26F 1/36 30/364
521,358 A * 6/1894 backus ..... B26F 1/36 30/364
4,707,924 A * 11/1987 Burney ..... B25B 7/12 30/363
5,067,242 A * 11/1991 Singer ..... B44B 5/0085 30/364
5,495,671 A * 3/1996 Shun-Yi ..... B23D 35/008 30/358
9,475,337 B2 * 10/2016 Riegler ..... B44B 5/0052

* cited by examiner

*Primary Examiner* — Ghassem Alie
*Assistant Examiner* — Fernando A Ayala
(74) *Attorney, Agent, or Firm* — Hamre, Schumann, Mueller & Larson, P.C.

(57) ABSTRACT

A handheld punching device includes an operating grip pivotably connected to a holding grip to have a loading end turned in an up-down direction, a transmitting lever pivotably connected to the loading end to transmit a torque to turn a driving end, a punching seat pivotably connected to the holding grip and defining a cutting space for receiving a workpiece to be punched, and a plurality of punch units disposed between the driving end and the punching seat and each having a punch head movably and fittingly disposed in the punching seat along a straight path in the up-down direction, and a press head in abutting engagement with the driving end to be moved by the torque and to drive movement of the punch head through the cutting space for creating a hole in the workpiece.

6 Claims, 12 Drawing Sheets

HANDHELD PUNCHING DEVICE

FIELD

The disclosure relates to a handheld punching device, and more particularly to a handheld punching device with a blade movable normal to a workpiece to make multiple holes in the workpiece with high precision.

BACKGROUND

A conventional handheld hole punch is used to create a hole in a workpiece, such as a hole punch pliers as disclosed in TW M277580, which includes two levers pivotably connected to each other at a fulcrum. A cutting punch rotating assembly and a die rotating assembly are respectively disposed at the front jaw ends of the levers, and respectively have a plurality of punch heads and a plurality of dies with a variety of dimensions. In use, the punch rotating assembly and a die rotating assembly are rotated manually and independently such that a selected punch head is registered with a corresponding die, and a workpiece is placed therebetween. By forcing the rear handle ends of the levers to turn the front jaw ends toward each other, the cutting edge of the punch head extends through the workpiece to form a hole therein. During the punch process, the punch head and the die are moved along their arcuate paths, rather than a straight linear path. Thus, the punch head is loosely moved into a hole in the die with a clearance therebetween, which reduces the steadiness of movement of the punch head and adversely affecting the quality of the cutout workpiece. Additionally, since the rotation of the punch heads and the corresponding dies are operated independently and non-synchronously, a mismatch therebetween might occur, resulting in damage to the punch heads and the dies.

SUMMARY

Therefore, an object of the disclosure is to provide a handheld punching device that can alleviate at least one of the drawbacks of the prior art.

According to the disclosure, the handheld punching device includes a holding grip, an operating grip, a transmitting lever, a punching seat and a plurality of punch units. The holding grip includes a hollow housing portion and a gripping portion which extends rearwardly from the housing portion. The operating grip includes a grip fulcrum portion which is pivotably connected to the housing portion, a forcing end which is disposed rearwardly of the grip fulcrum portion and below the gripping portion, and a loading end which is disposed forwardly of the grip fulcrum portion to be turned about the grip fulcrum portion in an up-down direction when the forcing end is moved relative to the gripping portion. The transmitting lever is disposed forwardly of the operating grip, and includes a transmitting fulcrum portion which is pivotably connected to the housing portion, a transmitting end which is disposed rearwardly of the transmitting fulcrum portion and which is linked to and turnable with the loading end to receive a torque as a result of turn of the loading end, and a driving end which is disposed forwardly of the transmitting fulcrum portion to be turned about the transmitting fulcrum portion by means of the torque in the same direction as the movement of the forcing end. The punching seat is pivotably connected to the housing portion adjacent to the driving end to be turnable in a left-right direction. The punching seat includes an upper die and a lower holder which are spaced apart from each other in the up-down direction to define a cutting space for receiving a workpiece to be punched. The upper die has a plurality of upper penetrating holes which are angularly displaced from each other and which penetrate in the up-down direction. The lower holder has a plurality of lower penetrating holes which are respectively registered and communicated with the upper penetrating holes in the up-down direction by the cutting space and which are respectively dimensioned substantially the same as the upper penetrating holes. The punch units are disposed between the driving end and the punching seat. Each of the punch units includes a punch head which is movably and fittingly disposed in a respective one of the lower penetrating holes in the up-down direction and which has at an upper end a blade edge facing the cutting space, a press head which is connected to a lower end of the punch head and which is disposed downwardly of the lower holder for abutting engagement with the driving end in the up-down direction such that the punch head is movable along the corresponding lower penetrating hole to the registered upper penetrating hole during the turning of the driving end to move the blade edge through the cutting space, and a biasing member which is disposed between the lower holder and the press head to bias the punch head downwardly.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 4:
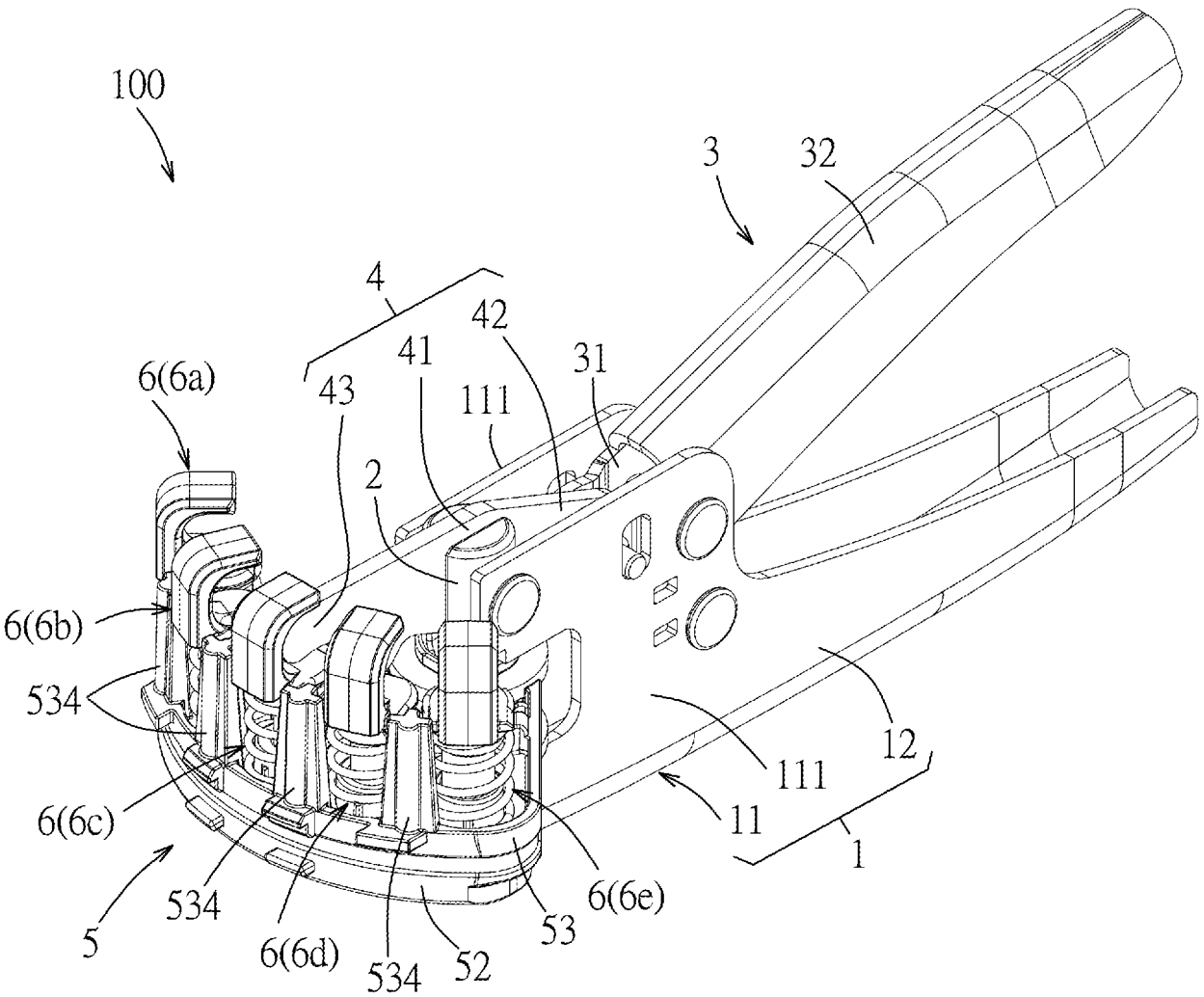
FIG. 4 is an inverted perspective view of FIG. 3.
Figure 5:
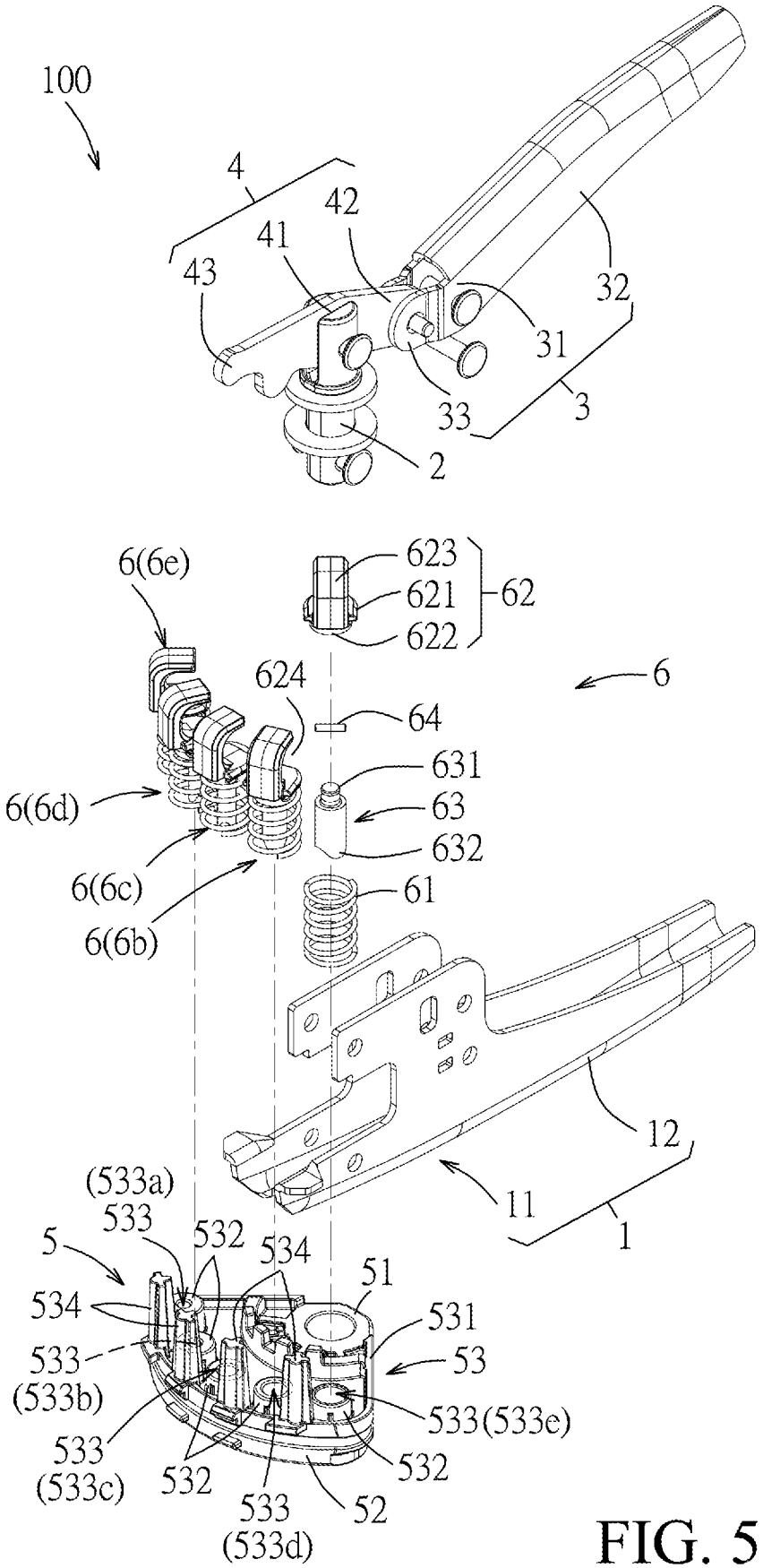
FIG. 5 is an exploded perspective view of FIG. 4.

To aid in describing the disclosure, directional terms may be used in the specification and claims to describe portions of the present disclosure (e.g., front, rear, left, right, up, down, etc.). These directional definitions are intended to merely assist in describing and claiming the disclosure and are not intended to limit the disclosure in any way. It is noted that FIGS. 4 and 5 are both inverted views in comparison to the other figures.

Referring to FIGS. 1, 2, 3 and 6, an embodiment of a handheld punching device 100 according to the disclosure is adapted to create a hole in a sheet workpiece 200, such as metal, paper, fiber, leather, and plastic materials, or the like, and includes a holding grip 1, an operating grip 3, a transmitting lever 4, a punching seat 5, a plurality of punch units 6, a positioning unit 7 and a housing shell 8.

Referring to FIGS. 2, 3, 5 and 6, FIG. 5 being an inverted exploded perspective view of the other figures, the holding grip 1 is made from a rigid metal material, and includes a hollow housing portion 11 and a gripping portion 12 which extends rearwardly from the housing portion 11. The housing portion 11 includes two side walls 111 extending in a front-rear direction and spaced apart from each other in a left-right direction to define therebetween an accommodation space for receiving a connecting shaft 2 which extends in an up-down direction. The gripping portion 12 and the housing portion 11 are integrally formed as a one-single piece. The connecting shaft 2 is connected to the side walls 111 by means of fasteners (not shown).

The operating grip 3 is made from a rigid metal material, and includes a grip fulcrum portion 31 which is pivotably connected to the side walls 111 of the housing portion 11 by means of a pivot axle (not shown) extending in the left-right direction, a forcing end 32 which is disposed rearwardly of the grip fulcrum portion 31 and below the gripping portion 12, and a loading end 33 which is disposed forwardly of the grip fulcrum portion 31 to be turned about the grip fulcrum portion 31 in the up-down direction when the forcing end 32 is moved relative to the gripping portion 12. The grip fulcrum portion 31, the forcing end 32 and the loading end 33 are integrally formed as a one-single piece.

Figure 6:
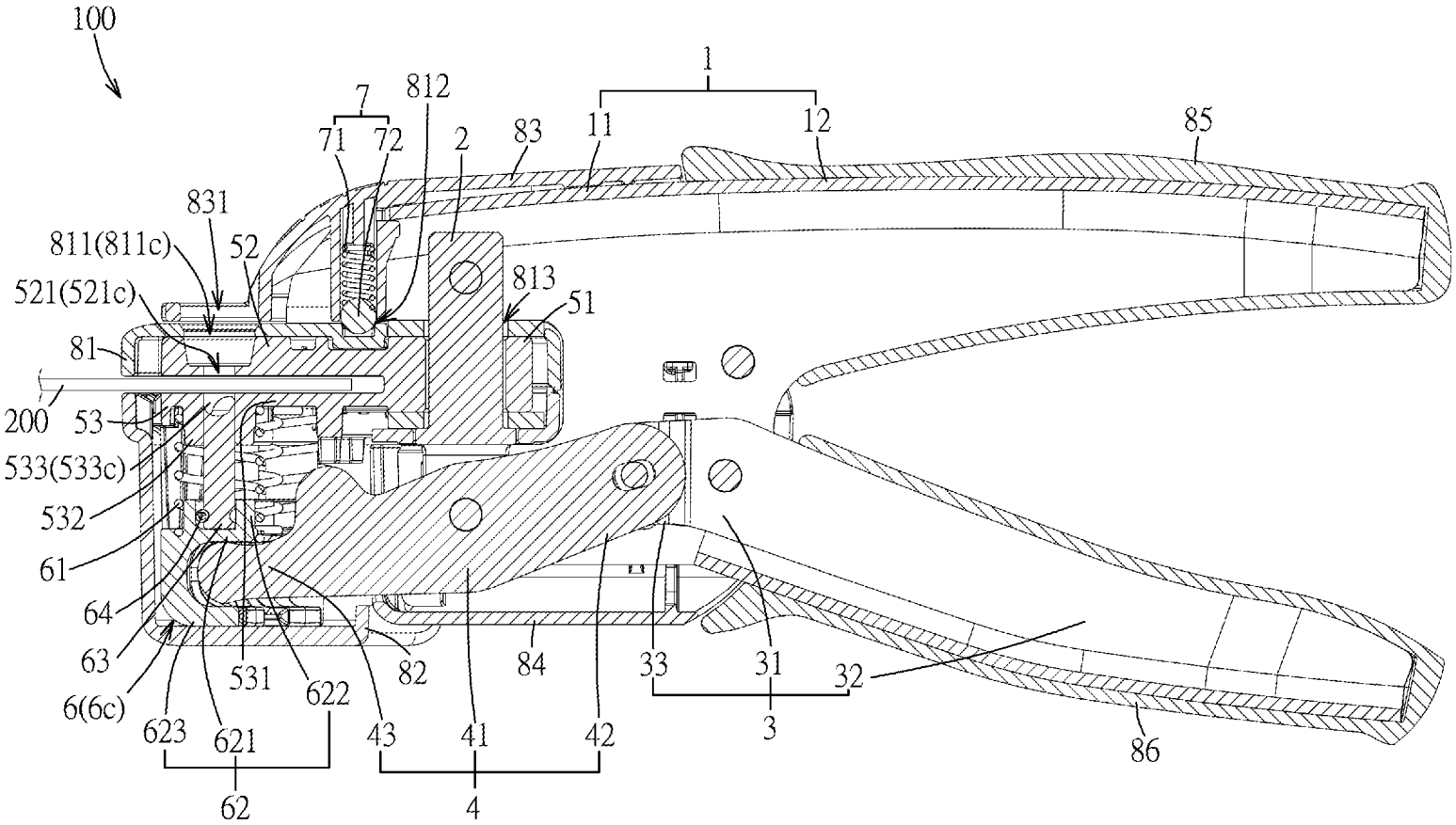
FIG. 6 is a sectional view taken along line VI-VI of FIG. 1.
Figure 8:
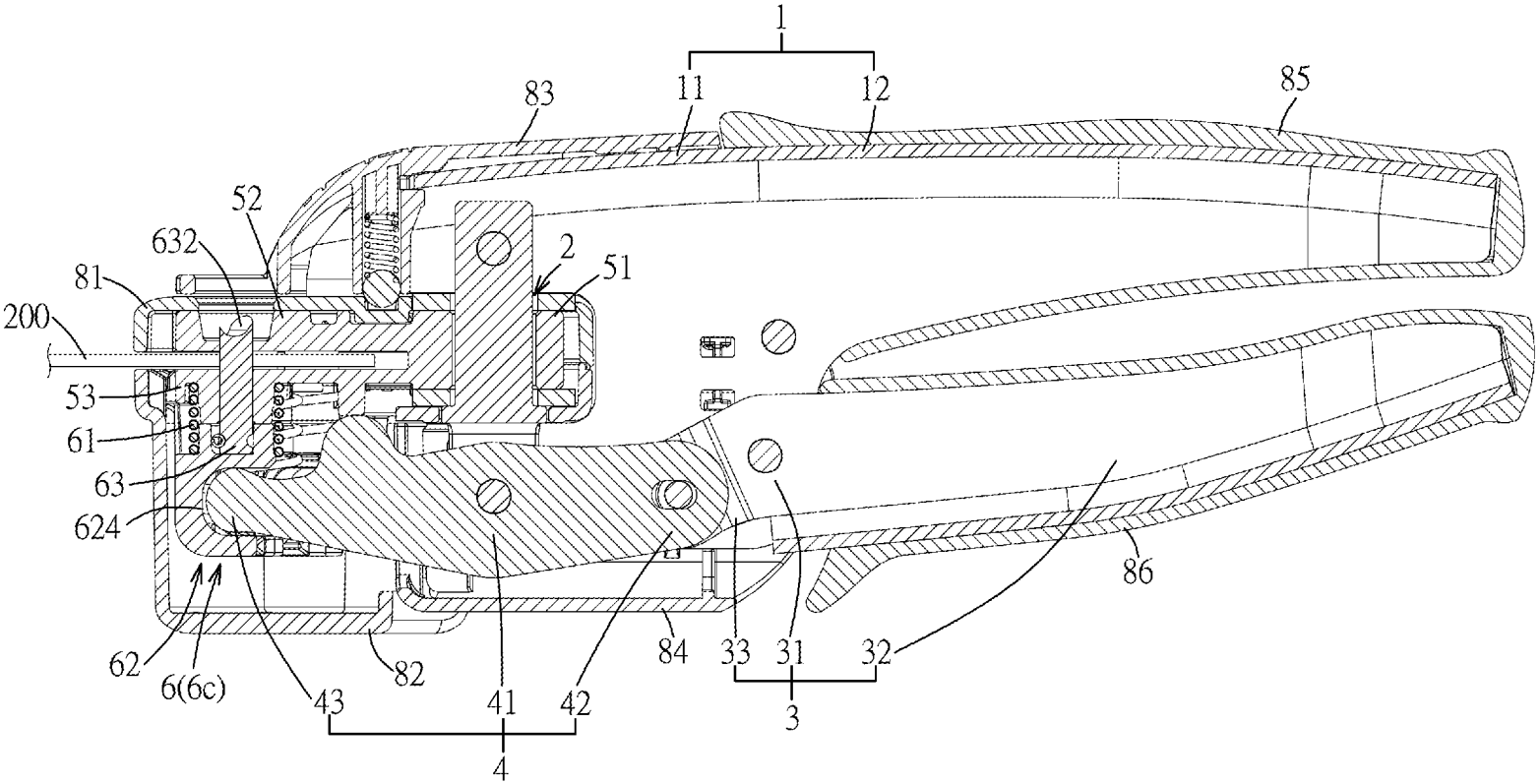
FIG. 8 is a sectional view taken along line VIII-VIII of FIG. 7.
Figure 9:
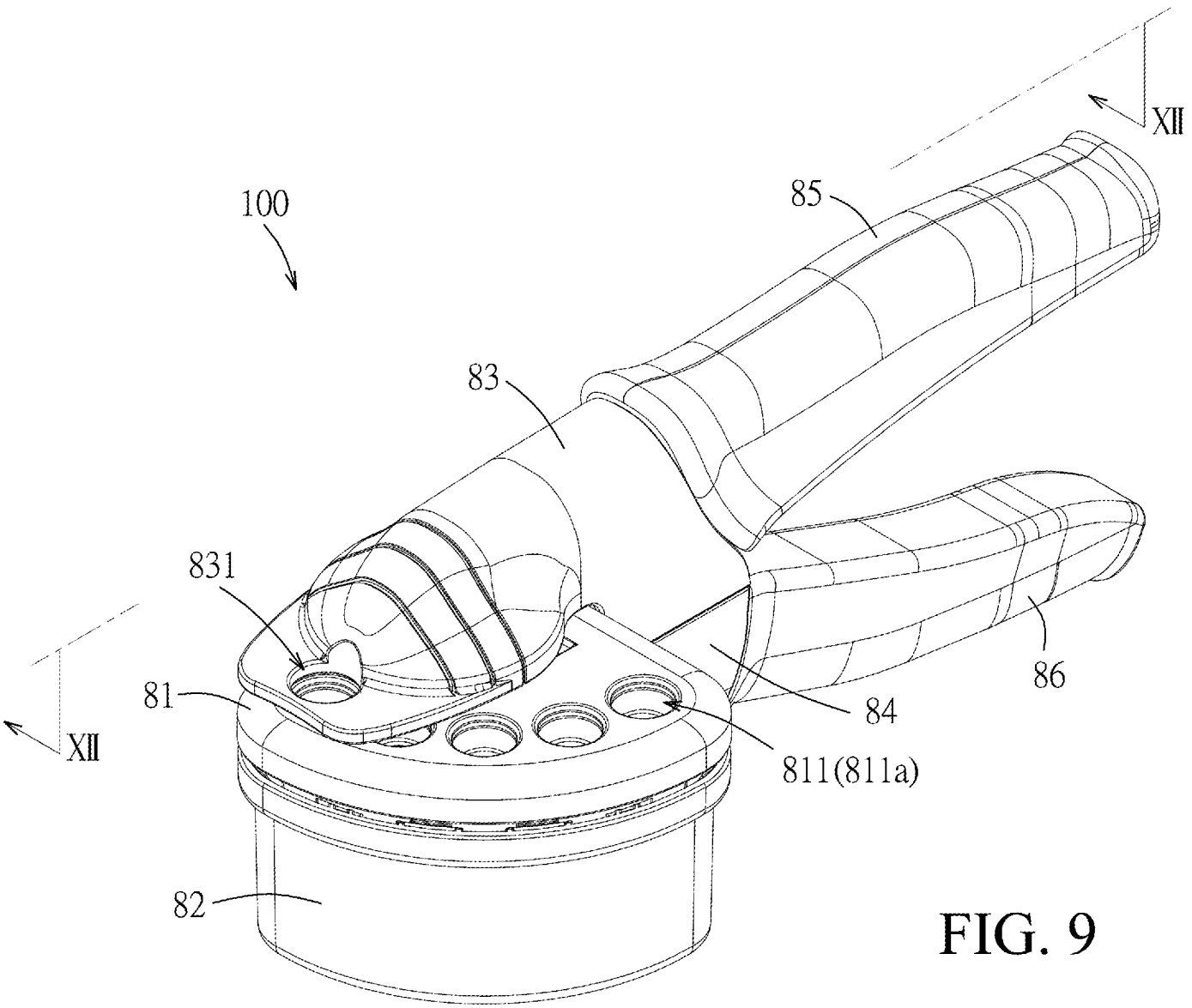
FIG. 9 is a perspective view similar to FIG. 1, illustrating the embodiment in another state of usage.
Figure 10:
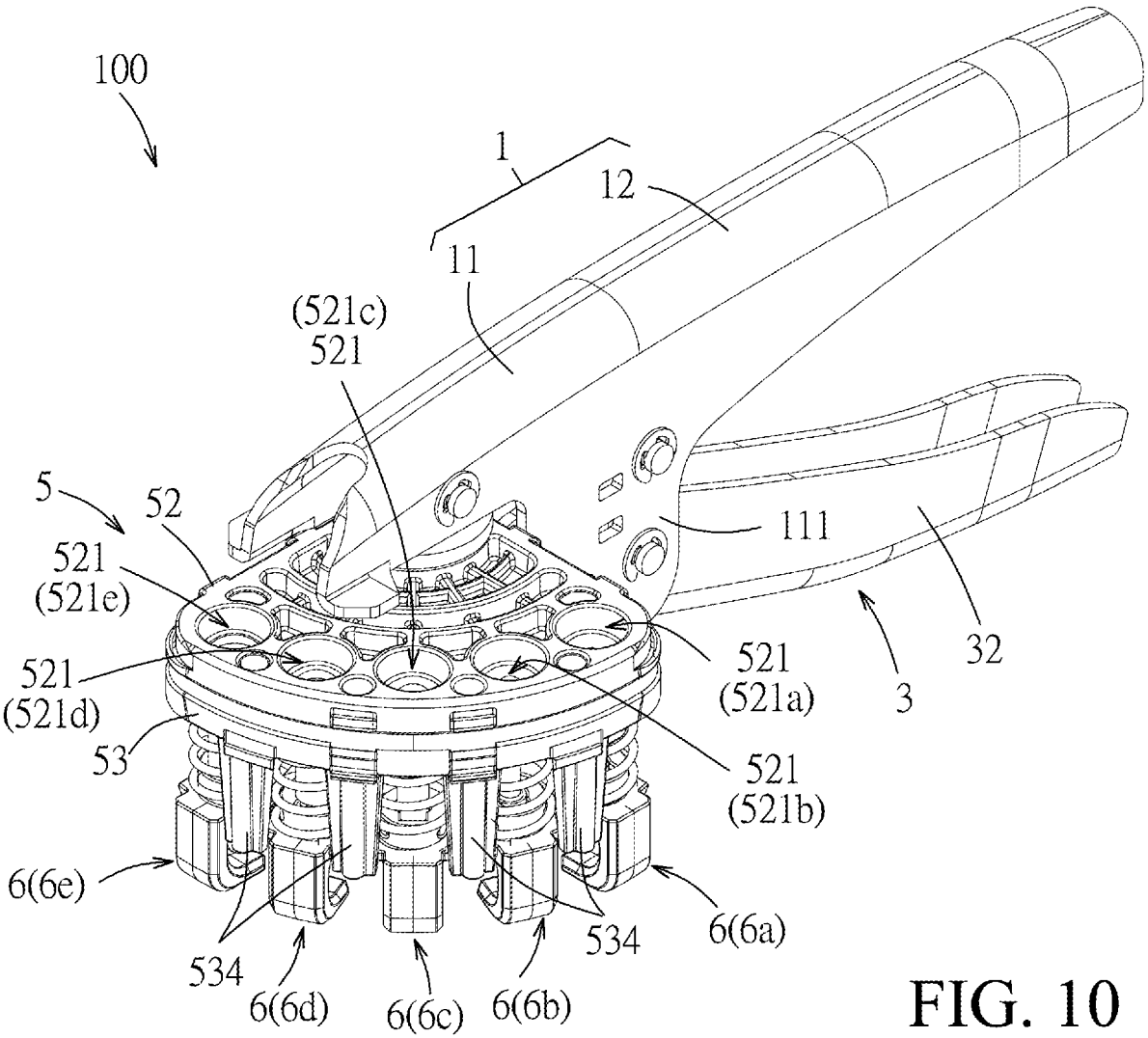
FIG. 10 is a perspective view similar to FIG. 3, illustrating the embodiment in a state of FIG. 9.
Figure 11:
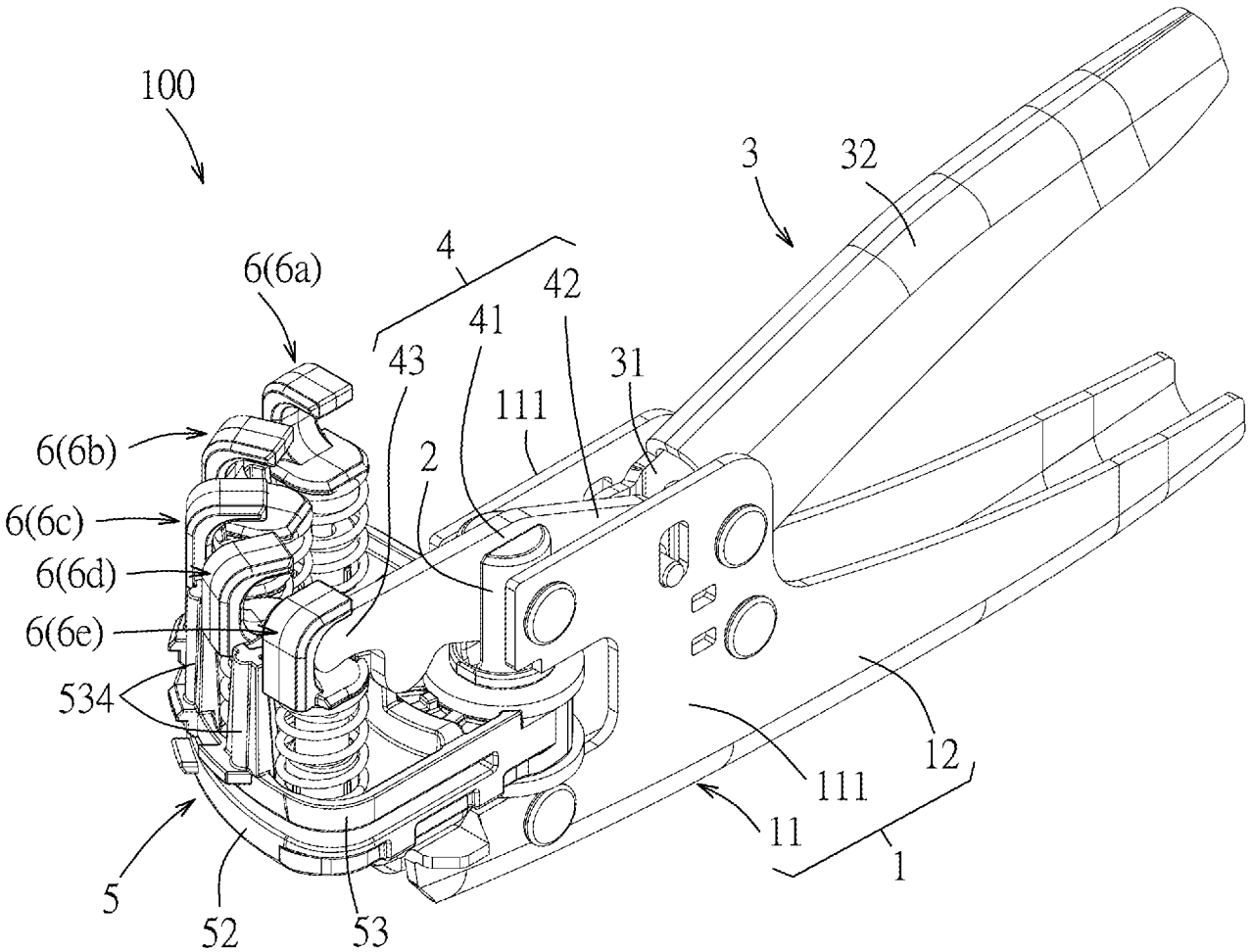
FIG. 11 is an inverted perspective view of FIG. 10.
Figure 12:
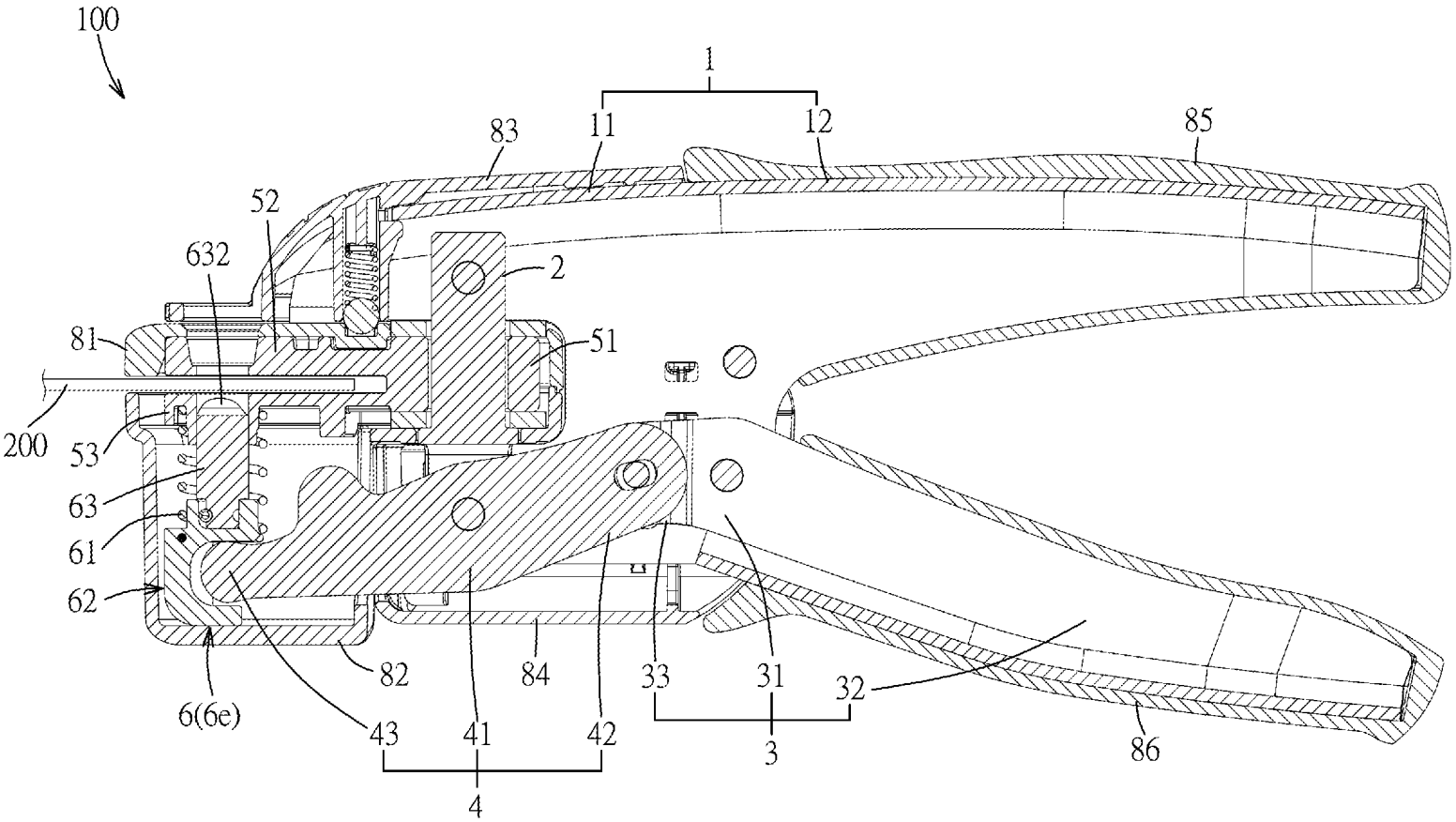
FIG. 12 is a sectional view taken along line XII-XII of FIG. 9.

The transmitting lever 4 is made from a rigid metal material, and is disposed forwardly of the operating grip 3. The transmitting lever 4 includes a transmitting fulcrum portion 41 which is pivotably connected to the connecting shaft 2 about a lower axis in the left-right direction, a transmitting end 42 which is disposed rearwardly of the transmitting fulcrum portion 41 and which is linked to and turnable with the loading end 33 to receive a torque as a result of turn of the loading end 33, and a driving end 43 which is disposed forwardly of the transmitting fulcrum portion 41 to be turned about the transmitting fulcrum portion 41 by means of the torque in the same direction as the movement of the forcing end 32. For example, as shown in FIGS. 6 and 8, when a user presses the forcing end 32 toward the gripping portion 12, the loading end 33 and the transmitting end 42 are turned away from the gripping portion 12, and the driving end 43 is turned upwardly. When a force is released from the forcing end 32, the forcing end 32 is biased to move away from the gripping portion 12 by means of a coil spring (not shown) which, at its two ends, abuts against the forcing end 32 and the gripping portion 12.

Referring to FIGS. 3 to 6, the punching seat 5 is made from a rigid metal material, and is of a sector shape. The punching seat 5 is pivotably connected to the housing portion 11 adjacent to the driving end 43 to be turnable in the left-right direction. Specifically, the punching seat 5 includes an upper die 52 and a lower holder 53 which are spaced apart from each other in the up-down direction to define a cutting space for receiving the workpiece 200 to be punched, and a pivot portion 51 which interconnects rear ends of the upper die 52 and the lower holder 53 and which is pivotably connected to the connecting shaft 2 about an upper axis in the up-down direction so as to permit the punching seat 5 to be turned in the left-right direction. In this embodiment, the pivot portion 51 is journalled on the connecting shaft 2.

The upper die 52 has a plurality of dimension-variable upper penetrating holes 521 which are angularly displaced from each other and which penetrate in the up-down direction. For example, five upper penetrating holes (521*a*-521*e*) are formed and respectively are 1/16, 1/8, 3/16, 1/4 and 5/16 inches in inner diameter. The upper penetrating holes 521 are angularly displaced from one another about the upper axis (i.e., the connecting shaft 2). Thus, a desired upper penetrating hole 521 can be selected by turning of the punching seat 5 relative to the housing portion 11.

The lower holder 53 is disposed closer to the transmitting lever 4 than the upper die 52, and has a main body 531, a plurality of tubular posts 532 which extend downwardly from an underside of the main body 531, a plurality of lower penetrating holes 533 which extend through the main body 531 and the tubular posts 532, which are respectively registered and communicated with the upper penetrating holes 521 in the up-down direction by the cutting space, and which are respectively dimensioned substantially the same as the upper penetrating holes 521, and a plurality of guiding rails 534 which extend downwardly from the main body 531 and which are disposed adjacent to the tubular posts 532. The tubular posts 532 are registered with the upper penetrating holes 521 for respectively loading the punch units 6. For example, five tubular posts 532 are provided and respectively have lower penetrating holes (533*a*-533*e*) that are angularly displaced from one another about the connecting shaft 2 and respectively registered with and dimensioned the same as the upper penetrating holes (521*a*-521*e*). In this embodiment, four guiding rails 534 are angularly displaced from one another about the connecting shaft 2, and are each disposed between two adjacent ones of the tubular posts 532. The guiding rails 534 are disposed radially and outwardly of the tubular posts 532 for preventing interference with the transmitting lever 4 during turning of the punching seat 5.

Referring again to FIGS. 3 to 6, the punch units 6 are disposed between the driving end 43 and the punching seat 5. For example, five punch units (6*a*-6*e*) are disposed to be angularly displaced from one another. Each of the punch units 6 includes a punch head 63 which is movably and fittingly disposed in the respective lower penetrating hole 533 in the up-down direction and which has at an upper end a blade edge 632 facing the cutting space, a press head 62 which is connected to a lower end 631 of the punch head 63 and which is disposed downwardly of the lower holder 53 for abutting engagement with the driving end 43 in the up-down direction such that the punch head 63 is movable along the corresponding lower penetrating hole 533 to the registered upper penetrating hole 521 during the turning of the driving end 43 to move the blade edge 632 through the cutting space, and a biasing member 61 which is disposed between the lower holder 53 and the press head 62 to bias the punch head 63 downwardly. In this embodiment, the press head 62 has an upper wall 621, a tubular protrusion 622 which extends upwardly from the upper wall 621 for insertion of the lower end 631 of the punch head 63 and for an end of the biasing member 61 in the form of a coil spring to be sleeved thereon, and a lower wall 623 which is spaced apart from the upper wall 621 in the up-down direction by a receiving gap 624 that opens in the left-right direction such that the driving end 43 is receivable in the receiving gap 624 by getting access thereto when a selected one of the punch units 6 (e.g., the punch unit 6*c* as shown in FIG. 6) is registered with the driving end 43. A fastening pin 64 is disposed to fasten the tubular protrusion 622 to the lower end 631 of the punch head 63. One of the upper wall 621 and the lower wall 623 is abutted again stand forced by the driving end 43 to move in the up-down direction during a punching process or a returning process. Additionally, the upper wall 621 of the press head 62 is in frictional and slidable engagement with at least one adjacent one of the guiding rails 534 during the movement of the punch head 63 along the lower penetrating hole 533 for further stabilizing the movement of the punch head 63. The diameter of the punch head 63 is substantially the same as those of the corresponding lower and upper penetrating holes 533, 521. The biasing member 61 is sleeved on the punch head 63 to have an end sleeved and connected on the corresponding tubular post 532.

Figure 1:
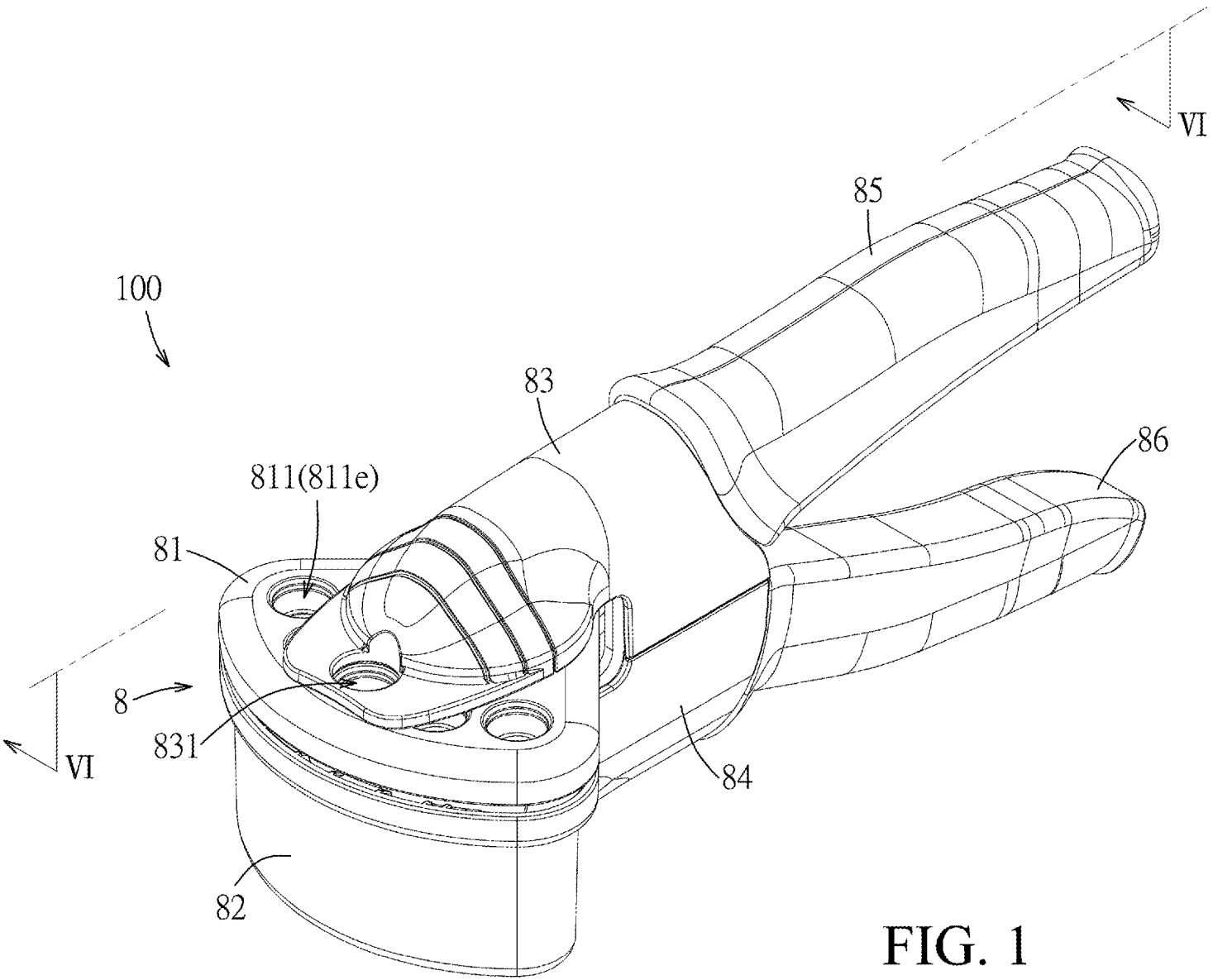
FIG. 1 is a perspective view illustrating an embodiment of a handheld punching device according to the disclosure.
Figure 2:
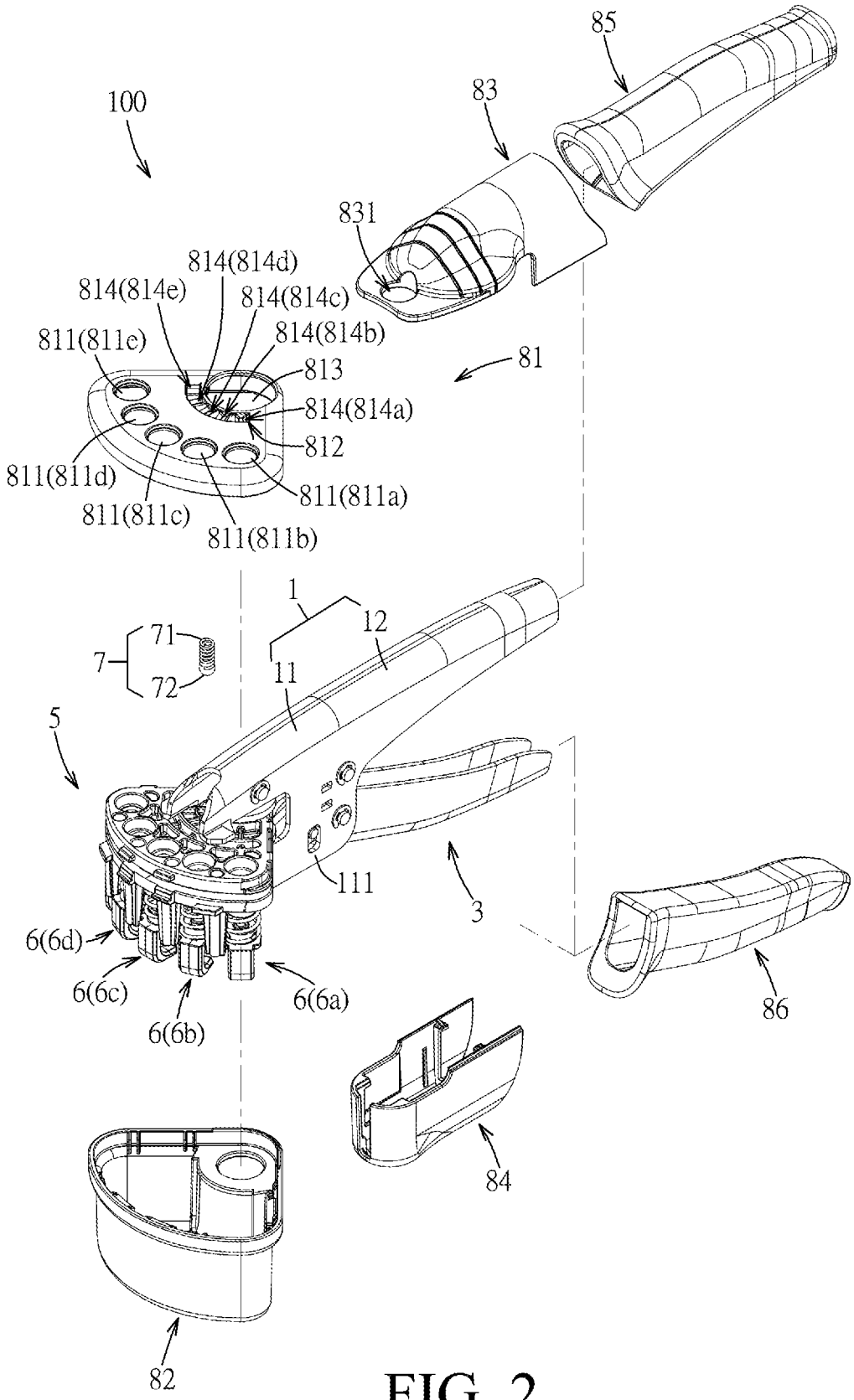
FIG. 2 is an exploded perspective view of FIG. 1.
Figure 3:
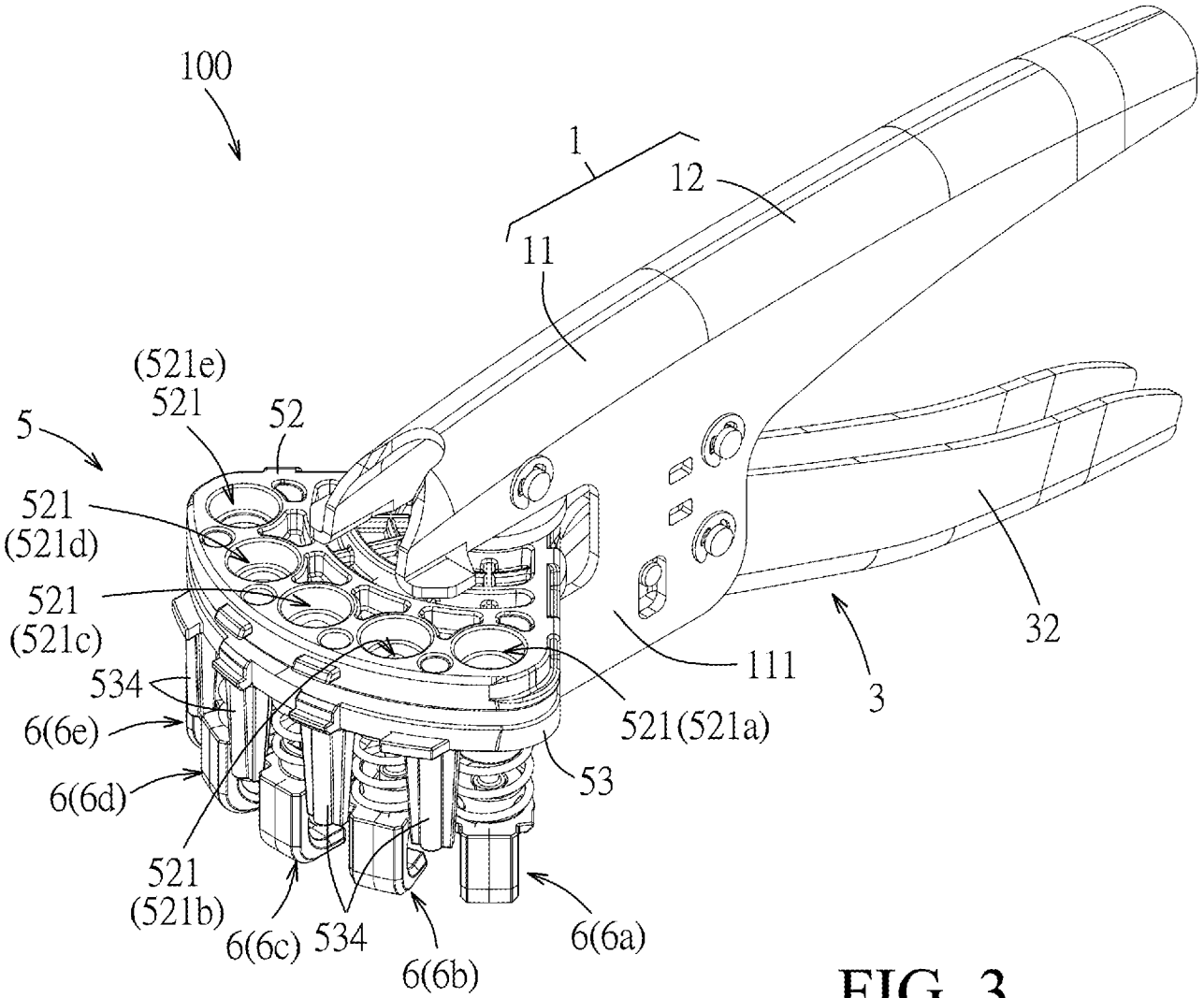
FIG. 3 is a perspective view of the embodiment, a housing shell being removed for the sake of clarity.

Referring to FIGS. 1, 2 and 6, the housing shell 8 includes a punching seat cover 81, a lower shell 82, an upper cover 83, a lower cover 84, an elastomeric upper sleeve 85 and an elastomeric lower sleeve 86.

The punching seat cover 81 is disposed on an upper side of the punching seat 5 and is made from a plastic material as an example. The punching seat cover 81 has a plurality of through holes 811 respectively registered with the upper penetrating holes 521 in the up-down direction, an arcuate groove 812 extending annularly about the connecting shaft 2 and spaced apart from the through holes 811, and a plurality of positioning slots 814 extending downwardly from the arcuate groove 812 and angularly displaced from each other about the connecting shaft 2. In this embodiment, the through holes (811*a*-811*e*) may be dimensioned equally in diameter. Each positioning slot 814 is in a radial line with the corresponding through hole 811. The lower shell 82 is made from a plastic material, and is disposed on a lower side of the punching seat 5 to receive and cover the lower holder 53 and the punch units 6. The upper cover 83 is made from a plastic material, and is disposed to cover the housing portion 11. The upper cover 83 has a front cover portion which is disposed above and spaced apart from the punching seat cover 81 and which has an observing hole 831 that is registered with one of the through holes 811 when the press head 62 of a selected one of the punching units 6 is turned to be connected to the driving end 43 for facilitating observation of interior of the punching seat 5 by a user. The lower cover 84 is coupled with the upper cover 83 to cover the housing portion 11, and is made from a plastic material. The elastomeric upper sleeve 85 is made from an elastomeric material and is sleeved on the gripping portion 12. The elastomeric lower sleeve 86 is sleeved on the forcing end 32 and is made from an elastomeric material.

The positioning unit 7 includes a positioning member 72 which is slidably disposed in the arcuate groove 812 during turning of the punching seat 5 and the punching seat cover 81 and which is engaged in a selected one of the positioning slots 814 when the press head 62 of a selected one of the punch units 6 is turned to be connected to the driving end 43, and a biasing member 71 which is disposed to bias the positioning member 72 downwardly to the selected one of the positioning slots 814. The biasing member 71 is a coil spring abutting against an inner wall surface of the upper cover 83 at an end so as to bias the positioning member 72 downwardly. The positioning member 72 is a steel ball slidable along the arcuate groove 812 during the turning of the punching seat 5 and engaged in the corresponding positioning slot 814 once the driving end 43 is registered with the selected punch unit 6, thereby frictionally positioning the punching seat 5.

Referring to FIGS. 1, 2, 3 and 6, when it is desired to create a hole in the workpiece 200 with a specific diameter, such as a hole of 3/16 inch in diameter, the punching seat 5 is turned to have the observing hole 831 be registered with the through hole 811*c*. At this stage, the upper and lower penetrating holes 521*c*, 533*c* and the punch unit 6*c* are registered with the observing hole 831, and the driving end 43 of the transmitting lever 4 is registered with the press head 62 of the punch unit 6*c*. The workpiece 200 is then placed in the cutting space between the upper die 52 and the lower holder 53. The user can grip the gripping portion 12 and the forcing end 32, and can adjust the workpiece 200 to register the observing hole 831 with a location to be punched.

Figure 7:
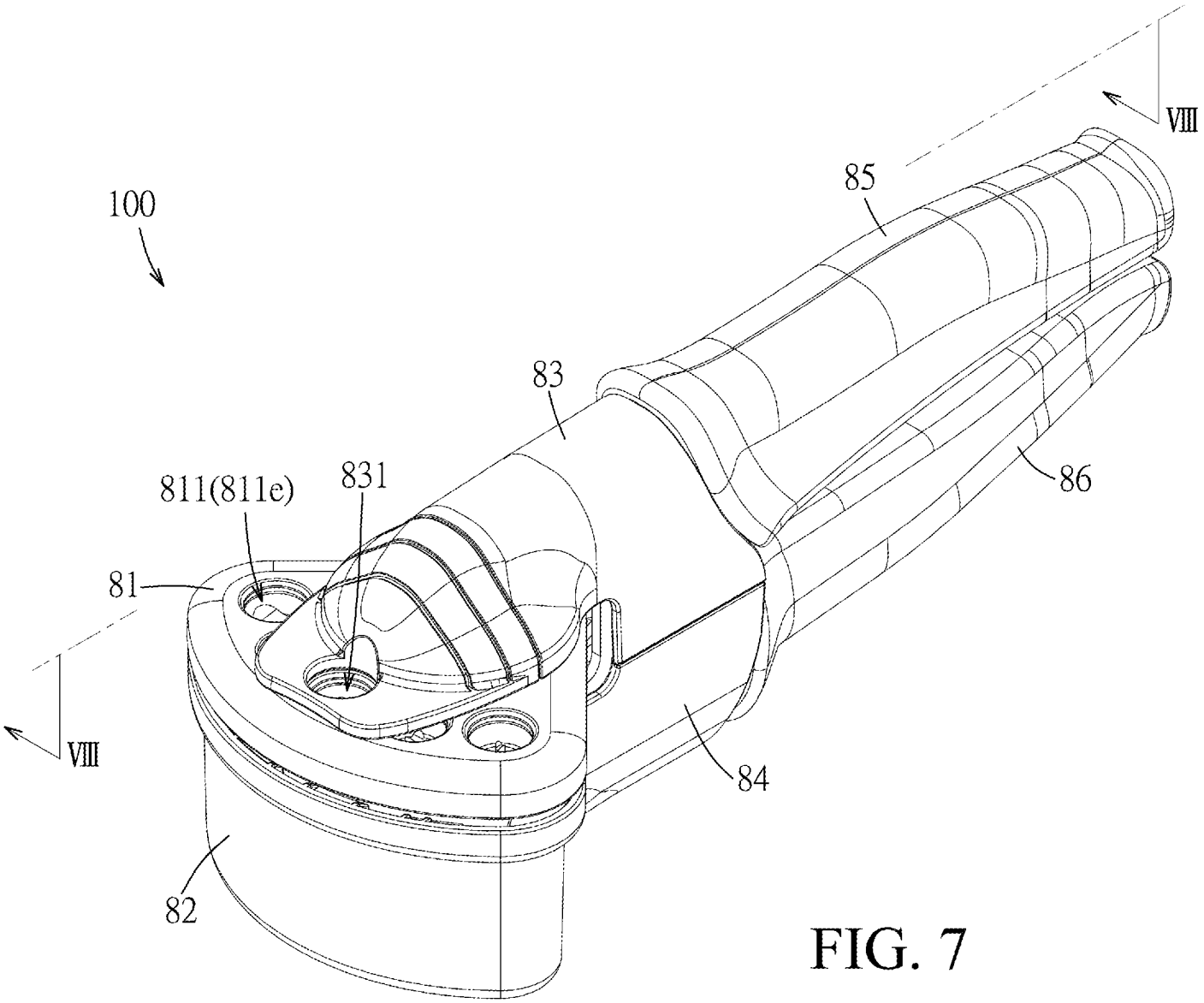
FIG. 7 is a perspective view similar to FIG. 1, illustrating the embodiment in a state of usage.

Referring to FIGS. 6 to 8, subsequently, the user can grip and force the forcing end 32 to turn upwardly toward the gripping portion 12 so as to turn the driving end 43 in the same direction. Accordingly, the driving end 43 abuts against and presses the press head 62 upwardly such that the punch head 63 is moved along the lower penetrating hole 533*c* to the registered upper penetrating hole 521*c* and through the workpiece 200 for forming a hole with 3/16 inch in diameter in the workpiece 200. During such punching process, the driving end 43 is moved (turned) along an arcuate path, while the punch head 63 is moved along a straight line path through the lower and upper penetrating holes 533*c*, 521*c* that extend in the up-down direction. Thus, the punch head 63 can be fit to the upper and lower penetrating holes 521*c*, 533*c* to minimize the clearance therebetween, which renders the movement of the punch head 63 smooth and stable so as to optimize the cutting action of the blade edge 632 to the workpiece 200 for precisely creating a hole in a thick or rigid workpiece 200. Finally, the user can release the force applied to the forcing end 32. Therefore, the press head 62 is moved downwardly by means of the biasing member 61 of the punch unit 6*c* to retreat the punch head 63 into the lower penetrating hole 533*c*, while the forcing end 32 is returned back to its original position relative to the gripping portion 12 by means of the coil spring (not shown).

Moreover, once the punch head 63 is not moved back by means of the biasing action of the biasing member 61 due to a clamping engagement of the punch head 63 with the workpiece 200 (especially when the workpiece 200 is quite thick or rigid, e.g., a metal workpiece), the user can force the forcing end 32 downwardly to turn away from the gripping portion 12, such that the driving end 43 is turned downwardly to abut against and press downwardly the lower wall 623 so as to move the punch head 63 and the press head 62 downwardly.

Referring to FIGS. 9 to 12, the observing hole 831 of the upper cover 83 is registered with the through hole 811*e*, the upper and lower penetrating holes 521*e*, 533*e* (with 1/4 inch in diameter) and the punch unit 6*e*, while the driving end 43 of the transmitting lever 4 is registered with the punch unit 6*e*. Thus, through turning of the punching seat 5, the punching seat cover 81 and the lower shell 82, the observing hole 831 can be registered with a selected one of the upper and lower penetrating holes 521, 533 and the punch units 6.

The number and shape of the upper and lower penetrating holes 521, 533, the punch units 6 and the through holes 811 can be varied. For example, one upper penetrating hole 521, one lower penetrating hole 533, one punch unit 6 and one through hole 811 may be provided.

As illustrated, with the punch units 6 disposed on the punching seat 5 and having the punch heads 63 respectively disposed in the lower penetrating holes 533, the turning of the driving end 43 of the transmitting lever 4 results in the straight movement of the punch head 63 of the selected punch unit 6 along the corresponding lower penetrating hole 533 in the up-down direction to the upper penetrating hole 521 for punching a hole in the workpiece 200. The punch heads 63 can be made fit to the corresponding upper and lower penetrating holes 521, 533 so as to precisely create a hole in a thick or rigid workpiece 200. Due to the synchronous movement of the punch head 63 and the corresponding die 52, no manual operation for aligning the punch head 63 and the corresponding die 52 as compared with the conventional hole punch is required, and thus the mismatch therebetween and damage thereto can be avoided. Moreover, with the lower wall 623, the punch head 63 and the press head 62 can be moved manually to return the punch unit 6 back to its original position once the punch head 63 is not moved back due to a clamping engagement of the punch head 63 with the workpiece 200.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A handheld punching device comprising:

a holding grip including a hollow housing portion and a gripping portion which extends rearwardly from said housing portion, said housing portion having a connecting shaft which extends in an up-down direction;

an operating grip including a grip fulcrum portion which is pivotably connected to said housing portion, a forcing end which is disposed rearwardly of said grip fulcrum portion and below said gripping portion, and a loading end which is disposed forwardly of said grip fulcrum portion to be turned about said grip fulcrum portion in the up-down direction when said forcing end is moved relative to said gripping portion;

a transmitting lever disposed forwardly of said operating grip, and including a transmitting fulcrum portion which is pivotably connected to said housing portion, a transmitting end which is disposed rearwardly of said transmitting fulcrum portion and which is linked to and turnable with said loading end to receive a torque as a result of turn of said loading end, and a driving end which is disposed forwardly of said transmitting fulcrum portion to be turned about said transmitting fulcrum portion by means of the torque in the same direction as the movement of said forcing end, said transmitting fulcrum portion of said transmitting lever being pivotably connected to said connecting shaft about a lower axis in a left-right direction so as to permit said driving end to be turned in the up-down direction;

a punching seat pivotably connected to said housing portion adjacent to said driving end to be turnable in the left-right direction, said punching seat including an upper die and a lower holder which are spaced apart from each other in the up-down direction to define a cutting space for receiving a workpiece to be punched, said upper die having a plurality of upper penetrating holes which are angularly displaced from each other and which penetrate in the up-down direction, said lower holder having a plurality of lower penetrating holes which are respectively registered and communicated with said upper penetrating holes in the up-down direction by said cutting space and which are respectively dimensioned substantially the same as said upper penetrating holes, said punching seat having a pivot portion which interconnects said upper die and said lower holder and which is pivotably connected to said connecting shaft about an upper axis in the up-down direction so as to permit said punching seat to be turned in the left-right direction, said upper penetrating holes being angularly displaced from each other about said connecting shaft;

a plurality of punch units, each of said punch units including a punch head which is movably and fittingly disposed in a respective one of said lower penetrating holes in the up-down direction and which has at an upper end a blade edge facing said cutting space, a press head which has an upper wall that is connected to a lower end of said punch head and that is disposed downwardly of said lower holder for abutting engagement with said driving end in the up-down direction such that said punch head is movable along said corresponding lower penetrating hole to said registered upper penetrating hole during turning of said driving end of said transmitting lever to move said blade edge through said cutting space, and a biasing member which is disposed between said lower holder and said press head to bias said punch head downwardly, said press head of each of said punch units having a lower wall which is spaced apart from said upper wall in the up-down direction by a receiving gap that opens in the left-right direction such that said driving end is receivable in said receiving gap by getting access thereto when a selected one of said punch units is registered with said driving end;

a housing shell including a punching seat cover which is disposed on an upper side of said punching seat and which has a plurality of through holes that are respectively registered with said upper penetrating holes in the up-down direction, an arcuate groove that extends annularly about said connecting shaft, and a plurality of positioning slots that extend downwardly from said arcuate groove and that are angularly displaced from each other about said connecting shaft, and an upper cover which is disposed to cover said housing portion; and a positioning unit including a positioning member which is slidably disposed in said arcuate groove during turning of said punching seat and said punching seat cover and which is engaged in a selected one of said positioning slots when said press head of a selected one of said punch units is turned to be connected to said driving end, and a biasing member which is disposed to bias said positioning member downwardly to the selected one of said positioning slots.

2. The handheld punching device as claimed in claim 1, wherein said press head of each of said punch units has a tubular protrusion which extends upwardly from said upper wall for insertion of said lower end of said punch head and for an end of said biasing member in form of a coil spring to be sleeved thereon, each of said punch units including a fastening pin which fastens said tubular protrusion to said lower end of said punch head.

3. The handheld punching device as claimed in claim 1, wherein said upper cover has a front cover portion which is disposed above said punching seat cover and which has an observing hole that is registered with one of said through holes when said press head of a selected one of said punching units is turned to be connected to said driving end.

4. The handheld punching device as claimed in claim 1, wherein said housing shell further includes a lower shell which is disposed on a lower side of said punching seat to cover said lower holder and said punch units, a lower cover which is coupled with said upper cover to cover said housing portion, an elastomeric upper sleeve which is sleeved on said gripping portion, and an elastomeric lower sleeve which is sleeved on said forcing end.

5. The handheld punching device as claimed in claim 1, wherein said lower holder has a main body and a plurality of tubular posts which extend downwardly from said main body, each of said lower penetrating holes penetrating said main body and a corresponding one of said tubular posts, an end of said biasing member of each of said punch units in form of a coil spring being sleeved on the corresponding one of said tubular posts.

6. The handheld punching device as claimed in claim 5, wherein said lower holder has a plurality of guiding rails which extend downwardly from said main body and which are disposed adjacent to said tubular posts such that said press head of each of said punch units is in frictional and slidable engagement with at least one adjacent one of said guiding rails during the movement of said punch head along said lower penetrating hole.

* * * * *